US007273510B2

(12) United States Patent
Saarinen

(10) Patent No.: US 7,273,510 B2
(45) Date of Patent: Sep. 25, 2007

(54) ARRANGEMENT AND METHOD FOR TAPPING A MOLTEN PHASE FROM A SMELTING FURNACE

(75) Inventor: Risto Saarinen, Espoo (FI)

(73) Assignee: Outokumpu Oyj, Espoo (FI)

( * ) Notice: Subject to any disclaimer, the term of this patent is extended or adjusted under 35 U.S.C. 154(b) by 544 days.

(21) Appl. No.: 10/493,913

(22) Filed: Apr. 26, 2004

(65) Prior Publication Data

US 2004/0256771 A1 Dec. 23, 2004

(30) Foreign Application Priority Data

Oct. 26, 2001 (FI) ..... 20012079

(51) Int. Cl.
*C21B 7/16* (2006.01)

(52) U.S. Cl. ..... 75/640; 266/44; 266/268; 266/236

(58) Field of Classification Search ..... 266/44, 266/265, 268, 236; 75/640
See application file for complete search history.

(56) References Cited

U.S. PATENT DOCUMENTS

| | | | | |
|---|---|---|---|---|
| 2,890,951 A * | 6/1959 | Roy | 266/236 |
| 3,832,163 A | 8/1974 | Themelis et al. | 75/74 |
| 4,614,541 A | 9/1986 | Berndt et al. | 75/74 |
| 5,579,705 A | 12/1996 | Suzuki et al. | 110/185 |
| 6,210,463 B1 * | 4/2001 | George et al. | 75/640 |
| 6,231,641 B1 * | 5/2001 | Utigard et al. | 75/640 |

FOREIGN PATENT DOCUMENTS

| | | |
|---|---|---|
| JP | 9243267 | 9/1997 |
| JP | 10219367 | 8/1998 |
| JP | 2002031323 | 1/2002 |

* cited by examiner

*Primary Examiner*—Scott Kastler
(74) *Attorney, Agent, or Firm*—Morgan & Finnegan, LLP

(57) ABSTRACT

The invention relates to an arrangement (1, 12, 16) for continuously tapping a molten phase, such as matte, from a smelting furnace, such as a flash smelting furnace, said arrangement comprising a matte tapping hole (5) provided in the furnace wall for discharging the molten phase from the furnace, an overflow tank (6) for receiving the molten phase (4), and an overflow edge (8) provided in the overflow tank for discharging the molten phase, so that in the smelting furnace, in the vicinity of the matte tapping hole (5), there can be arranged at least one heat-producing element (9, 15) in order to prevent the molten phase from being solidified. In addition, the invention relates to a method for continuously tapping a molten phase, such as matte, from a smelting furnace, such as a flash smelting furnace, according to which method the molten phase is discharged from the furnace through a matte tapping hole (5) provided in the furnace wall to an overflow tank (6), provided with an overflow edge (8) for discharging the molten phase, so that in the smelting furnace, in the vicinity of the matte tapping hole (5), there is arranged at least one heat-producing element (9, 15) in order to prevent the molten phase from being solidified.

16 Claims, 3 Drawing Sheets

ARRANGEMENT AND METHOD FOR TAPPING A MOLTEN PHASE FROM A SMELTING FURNACE

Figure 2:
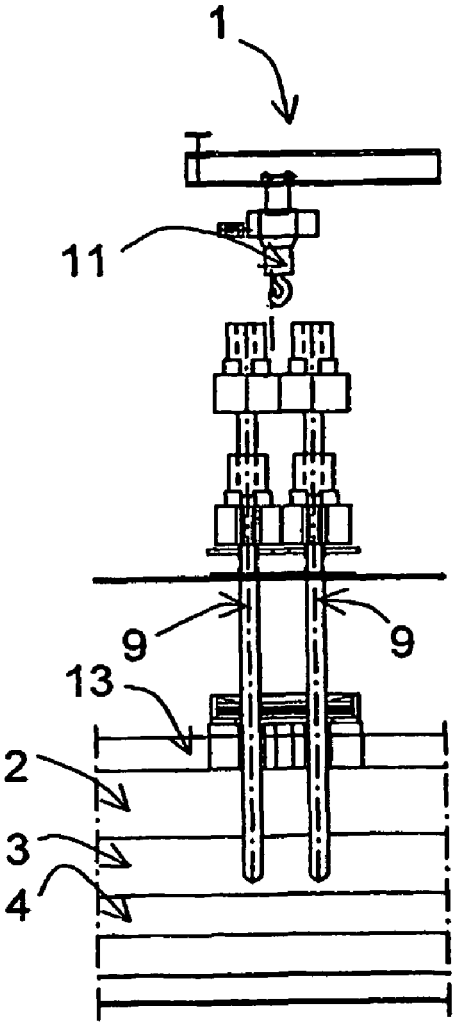

The invention relates to an arrangement for continuously tapping a molten phase, such as matte, from a smelting furnace, such as a flash smelting furnace, and to a method according to the independent claim for continuously tapping a molten phase, such as matte, from a smelting furnace, such as a flash smelting furnace.

In a flash smelting furnace belonging to a flash smelting process, the molten phases matte and slag are separated in separate layers at the furnace bottom. Depending on the next process step, the molten phase is tapped from the furnace in batches, although the feed into the furnace is operated continuously. The so-called flash converting process combined with flash smelting does not require a discontinuous matte tapping, but melt can be tapped in continuous operation. In this process there is achieved the advantage that the melt flows continuously also in the furnace, and the melt surfaces can be kept at a standard height. This feature has an essential effect in the capacity of the melt chamber of the furnace, and consequently it further lowers the copper content in the slag but on the other hand increases the wearing of the linings, because the surface is kept at the same height all the time. The linings tend to wear most remarkably particularly in the area of phase borders.

According to the prior art, the continuous tapping of a molten phase is realized by means of a siphon-type structure. In that case the molten phases are tapped in a continuous stream to an overflow tank, wherefrom they are discharged as an overflow to be processed further. The use of this method particularly in a flash smelting furnace is restricted by the fact that in case the melt feed should, because of an external reason, be interrupted, the molten phase located in the furnace tends to cool off, particularly at the bottom layer, and in the worst case it forms a congealed or even solid layer at the furnace bottom. A solution based on the traditional siphon arrangement for tapping the melt is does not work, because the tapping hole should in that case be gradually blocked by accretions, and it is in practice impossible to reopen it without stopping the furnace and removing the accretions mechanically, which is problematic from the point of view of the process.

The object of the invention is to introduce a novel method and arrangement for continuously tapping a molten phase, such as matte, from a smelting furnace such as a flash smelting furnace.

The invention is characterized by the arrangement including at least one heat-producing element located in the vicinity of the matte tapping hole in the flash smelting furnace, in order to prevent the molten phase from being solidified, the location of the heat-producing element being adjustable; and a method of placing in the flash smelting furnace, in the vicinity of the matte tapping hole, at least one heat-producing element in order to prevent the molten phase from being solidified, the location of the heat-producing element is capable of being adjusted. Other preferred embodiments of the invention are characterized herein.

According to the invention, into a smelting furnace, such as a flash smelting furnace, there is fed heat when necessary by means of at least two electrodes or by at least one deep burner, in which case, owing to the heat, the slag and matte layers present as molten phases are kept in a molten state as far as the furnace bottom, also during interruptions in the supply. According to the invention, at least one heat-producing element is in the smelting furnace set advantageously in the vicinity of a molten phase tapping hole, for example a matte tapping hole. A continuous tapping of the molten matte from the flash smelting furnace is further enhanced by using the method and arrangement according to the invention. The location of both the deep burner and the electrodes can be adjusted by means of a lifting gear connected thereto, so that they are not damaged in the furnace conditions during the smelting process. The deep burner can be directed so that the flame maintains the molten matte and slag layers located on the furnace bottom in a molten state as far as the bottom for instance when the feed supply is interrupted. The molten phase surfaces contained in a flash smelting furnace can be maintained at the desired height, so that an excessive wearing of the linings can be avoided. This also means that slag is not leaked out in connection with the tapping of the matte.

The invention is described in more detail below with reference the appended drawings FIG. 1 An arrangement according to the invention, provided with graphite electrodes FIG. 2 A cross-sectional illustration of the arrangement of FIG. 1

Figure 1:
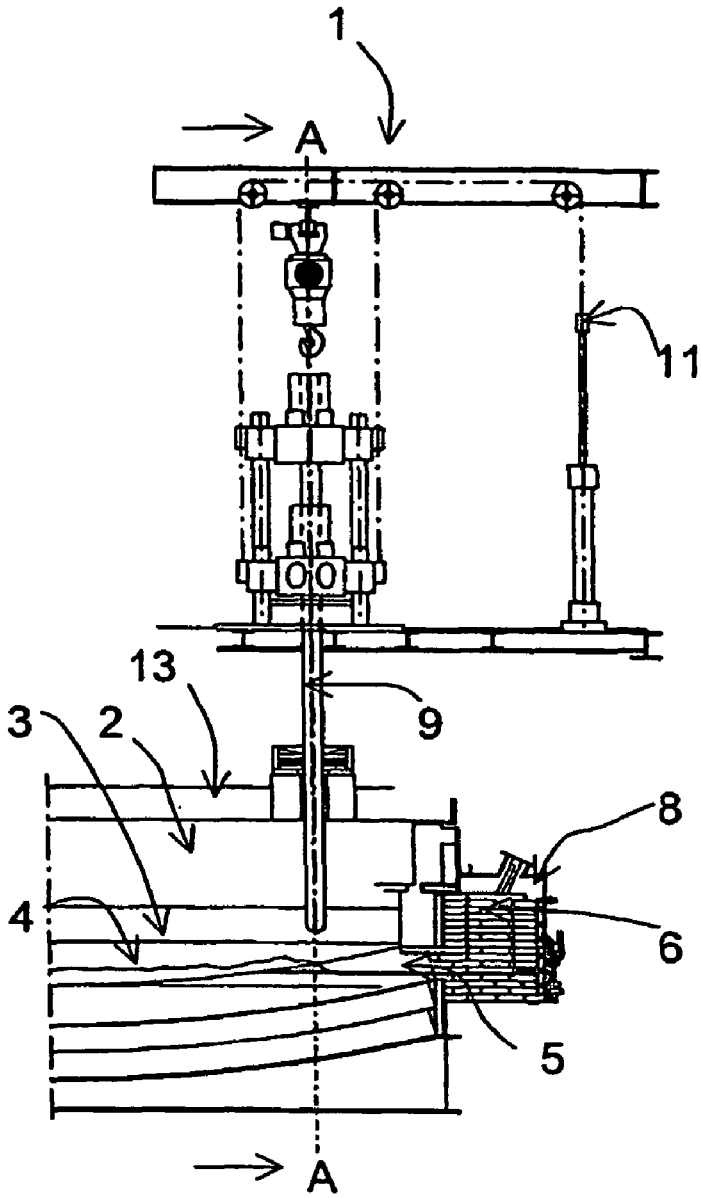
Figure 3:
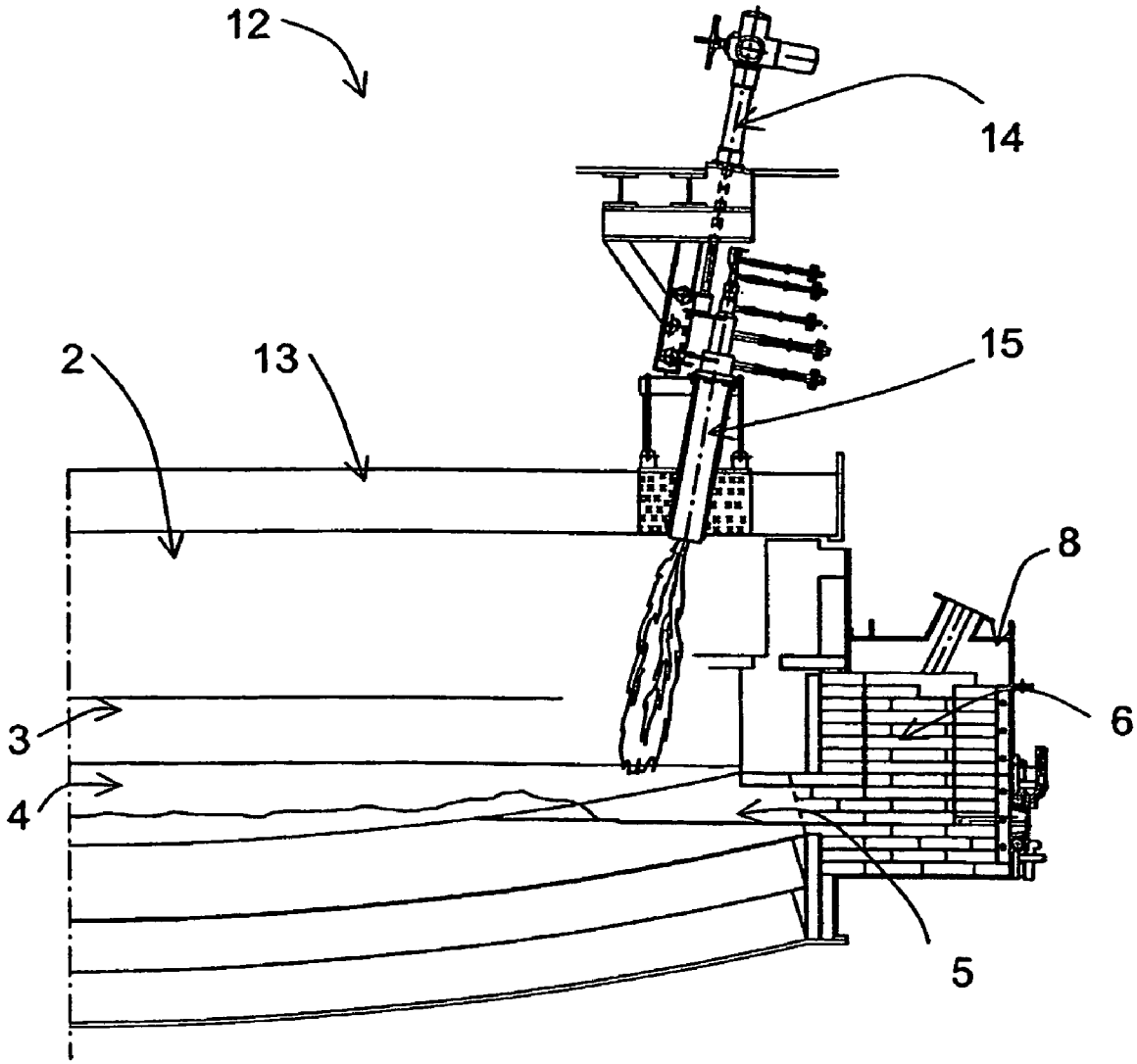
Figure 4:
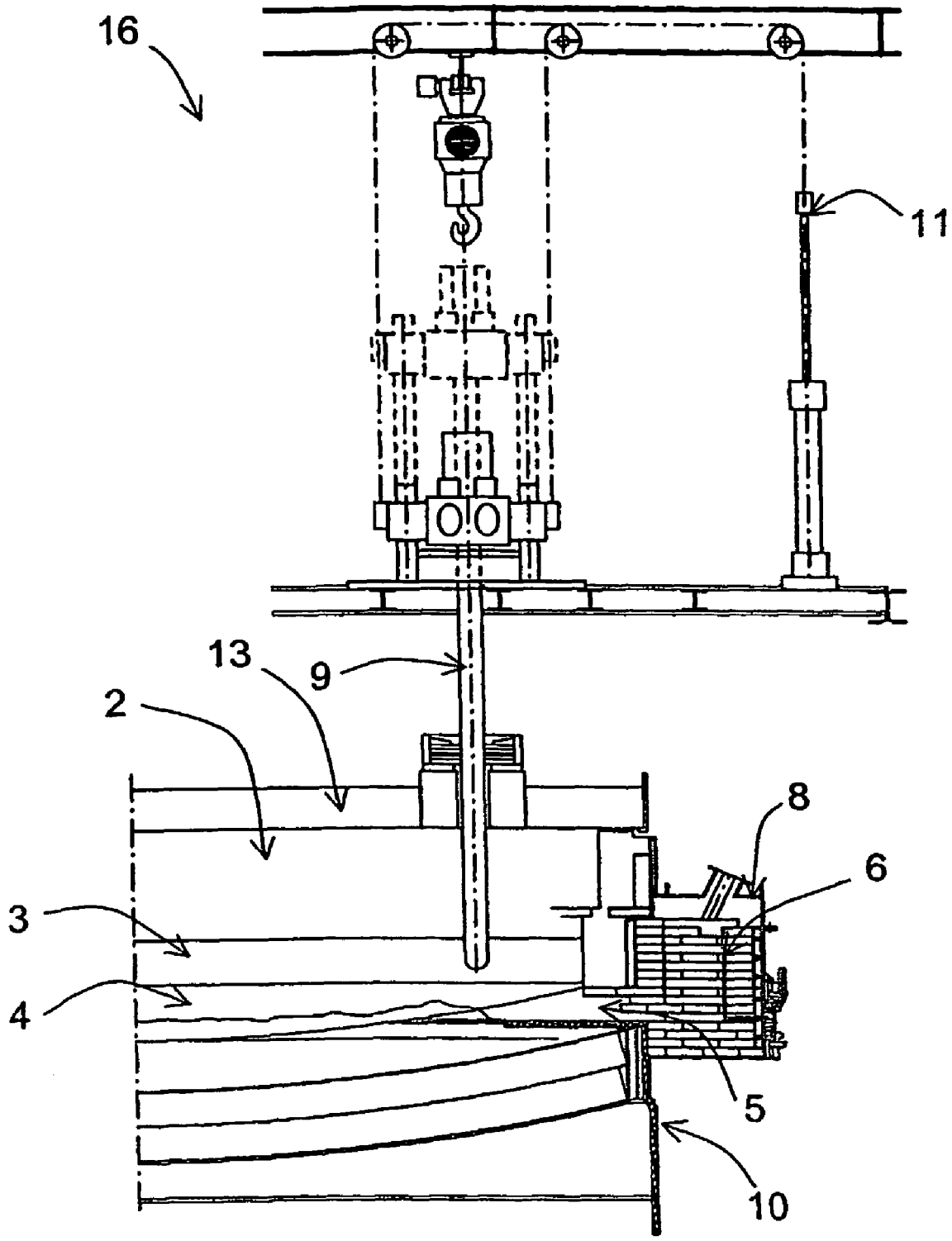

FIG. 3 An arrangement according to the invention, provided with a deep burner FIG. 4 An embodiment of the invention, provided with a graphite electrode FIGS. 1 and 2 illustrate a preferred embodiment of the invention. FIG. 2 shows a cross-section of FIG. 1 at the cross-sectional line A-A. In connection with the settler 2 of the smelting furnace, there is provided the arrangement 1 according to the invention. The molten phases, the slag layer 3 and the matte layer 4, are located on top of each other, so that the slag layer is located at a desired height on top of the matte layer, suitably so that none of the slag layer is discharged from the furnace during the tapping of the matte 4. The molten matte is tapped in a continuous flow through the matte tapping hole 5 made in the furnace wall, into a brick-lined overflow tank 6, provided with cooling elements according to the needs of the situation. The overflow tank 6 has an external gas or oil heating that is used when necessary. In the overflow tank, the surface of the molten matte rises, owing to the metallostatic/slagstatic pressure, higher than in the flash smelting furnace settler 2 itself. From the overflow tank 6, the matte is tapped as overflow at the overflow edge 8 provided in the tank in continuous operation to a matte launder, through which the molten matte flows to be processed further.

If the supply into the furnace is for some reason interrupted, the creation of possible congelations is prevented by means of a heat-producing element, such as two graphite electrodes 9. When the furnace is operated normally, the electrodes 9 are lifted, by means of a lifting gear 11 provided above the settler roof 13 that is connected to the electrodes, at a suitable height from the surface of the molten phase layers, so that the electrodes are not damaged by dust and excessive heat. In the settler, the graphite electrodes 9 are placed in the vicinity of the matte tapping hole 5, and when necessary, said electrodes can be lowered into the molten phase. The electrodes are immersed in the molten phase in an essentially vertical position, so that they extend to above the matte layer, as far as the slag phase. The electrodes 9 are arranged in the settler so that the heat created in the electrode keeps the front part of the matte tapping hole 5 and the passage in a molten state when the process is interrupted.

In the case according to FIG. 3, an arrangement 12 utilizing a deep burner 15 is used for continuously tapping matte from a flash smelting furnace. The molten matte 4 is continuously tapped from the furnace through the matte tapping hole 5 made in the furnace wall, into a brick-lined overflow tank 6 provided with the necessary cooling elements. The overflow tank 8 has external gas or oil heating, which is used when necessary. In the overflow tank, the surface of the molten matte rises, owing to the metallostatic/slagstatic pressure, higher than in the settler 2 of the flash smelting furnace itself. From the overflow tank 6, the matte is tapped over the overflow edge 8 provided therein as an overflow in continuous operation to a matte launder, through which the molten matte flows to be processed further.

During possible interruptions in the feed supply, or during other process interruptions owing to other reasons, the molten phases 3 and 4 are always maintained in a molten state by means of the heat-producing element, i.e. the deep burner 15. The deep burner 15 is arranged in the settler 2 so that it does not cause any overheating of the bricks in the wall. In connection with the deep burner, there is arranged a separate lifting gear 14 provided on the settler roof 13, in order to be able to adjust the position and angle of the deep burner 15 when necessary. When the furnace is operated normally, the deep burner is lifted to above the molten phases, where it is safe from possible damages caused by the heat, advantageously 400 mm higher than when the deep burner is in operation. If the feed supply is interrupted, the deep burner is lowered nearer to the molten phases, and owing to the special laval nozzle provided in the deep burner, the burner flame is made to proceed in the desired direction, so that the flame is capable of efficiently penetrating the molten layers. The orientation angle of the deep burner can be adjusted, and it is advantageously 5-15 degrees when the deep burner is in operation. The orientation angle and the flame burning efficiency can be adjusted to a level where the deep burner keeps the melt in a molten state as effectively as possible. Due to the heat produced by the deep burner, the temperature of the molten matte and slag rises, and the molten phases are kept in a molten state as far as the bottom of the settler.

FIG. 4 illustrates a preferred embodiment 16 of the invention, according to FIG. 1, where the counter electrode of the other electrode 9 is an earth electrode 10, placed at the bottom of the settler 2, in the vicinity of the tapping hole 5. Now the heat-producing elements are the graphite electrode 9, to be shifted through the roof 13 of the settler 2 by means of the lifting gear 11, and the earth electrode 10 of the graphite electrode. When the furnace functions normally, the graphite electrode 9 is lifted, by means of the lifting gear 11 located above the roof 13 of the settler, at a suitable height from the surface of the molten phases, in order to prevent the graphite electrode from being damaged by dust and overheating. The graphite electrode 9 is immersed in the melt when necessary, essentially in a vertical position, so that it extends to above the matte layer 4, as far as the slag phase 3. The graphite electrode 9 and the earth electrode 10 are placed in the settler so that the heat created in the electrodes keeps the front part of the matte tapping hole 5 and the passage in a molten state when the process is interrupted, thus preventing the melt from solidification.

For a man skilled in the art, it is apparent that the various preferred embodiments of the invention are not restricted to those described above, but may vary within the scope of the embodiments described herein.

The invention claimed is:

1. An arrangement for continuously tapping a matte molten phase from a flash smelting furnace, said arrangement comprising a matte tapping hole provided in the furnace wall for discharging the molten phase from the furnace, an overflow tank for receiving the molten phase, and an overflow edge provided in the overflow tank for discharging the molten phase, the arrangement including at least one heat-producing element, located in the vicinity of the matte tapping hole in the flash smelting furnace, in order to prevent the molten phase from being solidified, wherein the position of the heat-producing element is adjustable.

2. An arrangement according to claim 1 wherein the heat-producing elements are employed by at least two graphite electrodes.

3. An arrangement according to claim 1, wherein the heat-producing element is at least one deep burner.

4. An arrangement according to claim 1, wherein the employed heat-producing elements are a graphite electrode and an earth electrode.

5. An arrangement according to claim 1, wherein when the furnace functions normally, the heat-producing element can be placed above the molten phase by means of lifting gear of the heat-producing element.

6. An arrangement according to claim 1 wherein when feed supply is interrupted, the heat-producing element can be brought in the immediate vicinity of the molten phase by means of a lifting gear of the heat-producing element.

7. An arrangement according to claim 2, wherein the graphite electrode can be immersed in the molten phase in an essentially vertical position.

8. An arrangement according to claim 3, wherein the orientation angle of the deep burner can be adjusted, and wherein, the orientation angle is 5-15 degrees when the deep burner is in operation.

9. A method for continuously tapping a matte molten phase from a flash smelting furnace, comprising discharging the molten phase from the furnace through a matte tapping hole, provided in the furnace wall, to an overflow tank, provided with an overflow edge for discharging the molten phase, placing in the flash smelting furnace, in the vicinity of the matte tapping hole, at least one heat-producing element in order to prevent the molten phase from being solidified, and wherein the position of the heat-producing element is adjustable.

10. A method according to claim 9, wherein heat is produced by at least two graphite electrodes.

11. A method according to claim 9, wherein heat is produced by at least one deep burner.

12. A method according to claim 9, wherein heat is produced by a graphite electrode and an earth electrode.

13. A method according to claim 9, wherein during the normal operation of the furnace, the heat-producing element is placed above the molten phase by a lifting gear of the heat-producing element.

14. A method according to claim 9, wherein when the feed supply is interrupted, the heat-producing element is brought into the immediate vicinity of the melt by the lifting gear of the heat-producing element.

15. A method according to claim 10, wherein the graphite electrode is immersed in the molten phase in an essentially vertical position.

16. A method according to claim 11, wherein the orientation angle of the deep burner is adjustable, and wherein the orientation angle is 5-15 degrees when the deep burner is in operation.

* * * * *